US012715633B2

(12) United States Patent
Jochemsen et al.

(10) Patent No.: US 12,715,633 B2
(45) Date of Patent: Aug. 25, 2026

(54) PACKAGING DEVICE AND METHOD FOR PACKAGING DISCRETE MEDICAMENTS IN POUCHES

(71) Applicant: VMI Holland B.V., Epe (NL)

(72) Inventors: Cornelis Jan Jochemsen, Epe (NL); Aalf Wijnia, Epe (NL); Robert Ernst Onderdelinden, Epe (NL); René Smit, Epe (NL)

(73) Assignee: VMI Holland B.V., Epe (NL)

( * ) Notice: Subject to any disclaimer, the term of this patent is extended or adjusted under 35 U.S.C. 154(b) by 83 days.

(21) Appl. No.: 18/291,961

(22) PCT Filed: Aug. 4, 2022

(86) PCT No.: PCT/EP2022/071981

§ 371 (c)(1),
(2) Date: Jan. 25, 2024

(87) PCT Pub. No.: WO2023/012285

PCT Pub. Date: Feb. 9, 2023

(65) Prior Publication Data

US 2025/0002187 A1 Jan. 2, 2025

(30) Foreign Application Priority Data

Aug. 5, 2021 (NL) ..... 2028931

(51) Int. Cl.
*B65B 41/16* (2006.01)
*B65B 9/073* (2012.01)
(Continued)

(52) U.S. Cl.
CPC ..... *B65B 9/073* (2013.01); *B65B 9/093* (2013.01); *B65B 41/16* (2013.01); *B65B 51/14* (2013.01);
(Continued)

(58) Field of Classification Search
CPC ..... B65B 41/16; B65B 9/093; B65B 51/14; B65B 51/26; B65B 57/04; B65H 23/192;
(Continued)

(56) References Cited

U.S. PATENT DOCUMENTS 6,178,725 B1 * 1/2001 Sperry ..... B29C 66/8227 53/553
6,247,293 B1 * 6/2001 Todd ..... B29C 66/431 53/329.2
(Continued)

FOREIGN PATENT DOCUMENTS

EP 0165818 B1 8/1989
EP 626313 A1 * 11/1994 ..... B65B 41/16
(Continued)

*Primary Examiner* — Andrew M Tecco
(74) *Attorney, Agent, or Firm* — Ipsilon USA—NLO

(57) ABSTRACT

A packaging device for packaging discrete medicaments in pouches that is configured to form and fill the pouches in an elongated web to contain the medicaments comprises a web drive for guiding the elongated web in a transport direction along a web trajectory, wherein the packaging device further comprises a sealing station along the web trajectory, wherein the sealing station is configured to apply a seal to the elongated web to form at least a part of a pouch.

21 Claims, 5 Drawing Sheets

(51) Int. Cl.

| | |
|---|---|
| ***B65B 9/093*** | (2012.01) |
| ***B65B 51/14*** | (2006.01) |
| ***B65B 51/30*** | (2006.01) |
| ***B65B 57/04*** | (2006.01) |
| ***B65H 23/188*** | (2006.01) |

(52) U.S. Cl.
CPC ..... *B65B 51/30* (2013.01); *B65B 57/04* (2013.01); *B65H 23/1884* (2013.01); *B65H 2515/32* (2013.01); *B65H 2801/81* (2013.01)

(58) Field of Classification Search
CPC ..... B65H 23/1888; B65H 23/1884; B65H 2801/81; B65H 2515/32
See application file for complete search history.

(56) References Cited

U.S. PATENT DOCUMENTS

| | | | | |
|---|---|---|---|---|
| 2013/0205964 | A1* | 8/2013 | Matsushita | B65C 9/1803 83/209 |
| 2021/0008784 | A1* | 1/2021 | Quaglia | B29C 55/06 |

FOREIGN PATENT DOCUMENTS

| | | | |
|---|---|---|---|
| EP | 2634105 | A1 | 9/2013 |
| JP | 410118159 | A | 5/1998 |

* cited by examiner

PACKAGING DEVICE AND METHOD FOR PACKAGING DISCRETE MEDICAMENTS IN POUCHES

BACKGROUND

The current disclosure relates to a device for packaging discrete medicaments in pouches, and further relates to a method for packaging discrete medicaments in pouches. Such packaging devices are used for packaging large amounts of pouches with usually a small selection of dose units each to be administered at once to a patient.

Known packaging devices are arranged to form pouches in an elongate web and to fill said pouches with a discrete medicament. Subsequently, the pouches are sealed to contain the discrete medicaments. The known packaging device comprises a driven roller for pulling the elongate web along a trajectory through the sealing and filling parts of the packaging device.

SUMMARY

A disadvantage of the known packaging device is that the pulling of the driven roller on the elongate web may lead to high stresses or strains in said elongate web. The stresses or strains may cause elongation in the elongate web. Moreover, said stresses or strains may cause the seals to be defective or of inferior quality. Ultimately, the stresses or strains in the elongate web may lead to rupture of the elongate web. Said structural shortcomings may compromise the quality of the resulting pouches.

It is an object of the present invention to provide a packaging device and a method for packaging discrete medicaments in pouches in which the quality of the pouches can be increased.

According to a first aspect, the invention relates to a packaging device for packaging discrete medicaments in pouches, wherein the packaging device is configured to form and fill the pouches in an elongated web to contain the medicaments, wherein the packaging device comprises a web drive for guiding the elongated web in a transport direction along a web trajectory, wherein the packaging device further comprises a sealing station along the web trajectory, wherein the sealing station is configured to apply a seal to the elongated web to form at least a part of a pouch, wherein the web drive comprises a driven infeed roller upstream of the sealing station in the transport direction for feeding the elongate web in the transport direction to the sealing station.

The driven infeed roller can pull the elongate web along the web trajectory upstream of the sealing station. Consequently, a stress or strain in the elongate web at the sealing station, e.g., downstream of the driven infeed roller, can be reduced. In particular, a stress or strain in the newly created seal can be kept constant or can even be reduced. This is especially beneficial when a seal needs to settle, e.g. a heat seal or a chemical bond. Hence, tearing or rupture of the seal and the pouch as a whole can be prevented. Thus, the overall quality and reliability of the pouches can be improved.

According to a second aspect, the invention relates to a packaging device for packaging discrete medicaments in pouches, wherein the packaging device comprises a web drive for guiding the elongated web in a transport direction along a web trajectory, wherein the packaging device further comprises a sealing station along the web trajectory, wherein the scaling station is configured to apply a seal in the elongated web to form at least a part of a pouch, wherein the web drive comprises a driven output roller downstream of the scaling station in the transport direction for pulling the elongate web in the transport direction along the web trajectory, wherein the packaging device further comprises a control unit that is operationally connected to the sealing station and the web drive, wherein the control unit is configured to perform the steps of:

a) controlling the web drive to drive the elongate web in the transport direction along a web trajectory at a constant transport torque of the output roller;
b) controlling the web drive to cease the transportation of the elongate web and controlling the sealing station to locally apply a seal to the elongate web for forming at least a part of a pouch; and
c) controlling the web drive to drive the output roller at a constant first velocity to gradually increase the torque back to the transport torque. The packaging device can be configured to form and fill the pouches in an elongated web to contain the medicaments.

In an embodiment thereof, the web drive further comprises a driven output roller downstream of the sealing station in the transport direction for pulling the elongate web in the transport direction. Hence a tension in the elongate web can be controlled by adapting the relative velocity between the input roller and the output roller. Optionally, the output roller is a knurled roller. A knurled roller can have a solid grip on the elongate web.

In a further embodiment, the packaging device further comprises a dancer upstream of the driven infeed roller and/or downstream of the driven outfeed roller. Optionally, the dancer comprises two dancer rollers. While the packaging device transports the elongate web intermittently, the elongate web is generally provided to the packaging device at a constant speed. The dancer and/or dancer rollers can mitigate tensions resulting from any differences in transport velocities, for example between the infeed roller and the output roller. One or more sensors may also be used to determine the positions of dancer rollers, and therefore send signals to the control unit to adjust the input or output accordingly.

In a further embodiment, the web trajectory comprises at least fifty percent of the circumference of the infeed roller, preferably at least sixty percent, more preferably at least seventy percent. In other words, the elongate web can be wrapped around at least fifty, at least sixty or at least seventy percent of the circumference of the infeed roller. Hence, the contact surface between the infeed roller and the elongate web can be increased. Thus, the infeed roller can reliably retain the elongate web by friction. Optionally, the infeed roller can be rubber or another material which also helps to retain the elongate web by friction.

In a further embodiment, the web drive comprises two auxiliary rollers for guiding the elongate web along the circumference of the infeed roller. The auxiliary rollers can guide the elongate web around an increased portion of the circumference of the infeed roller, thus improving the grip of said infeed roller. In some embodiments, at least one of these auxiliary rollers can be connected to a spring-loaded rotatable holder which helps to ensure that the elongate web is held against the infeed roller during operation. Holder can be spring-loaded such that an operator can easily overcome the spring force to rotate open for loading an elongate web, but then the spring force brings the holder with roller back into position to hold the web against the infeed roller once the operator lets go. Optionally, the holder can include one or more holes or other gripping features for the manual manipulation. Such a holder can, for example, use a gas spring which pushes against the infeed roller with 5-15 Newtons to ensure the elongate web stays connected to infeed roller during operations.

In a further embodiment, the web drive comprises one or more pins which are located just outside the shortest web path between two rollers. The pins typically have a smaller diameter than the rollers, for example, 2-5 mm, and the elongate web goes around the pins on its way between rollers, taking it slightly outside the shortest web path between the rollers and around this smaller diameter pin. The rollers can be auxiliary rollers and/or driven rollers, and bringing the elongate web slightly outside the shortest path around these smaller pins helps to remove any wrinkles which may be in the elongate web thereby ensuring the pouches are formed correctly in the web at the sealing station.

In a further advantageous embodiment, the infeed roller extends at an oblique angle with respect to the web trajectory.

In an embodiment thereof, the sealing station comprises a press for applying the seals to the elongate web by pressing said elongate web together in a sealing direction transverse to the transport direction. Preferably, the press is a hot press and wherein the seals are heat seals. The hot press can include one or more sealing bars or presses. A hot press can reliably seal foils together. The reduced strain in between the driven output roller and the driven infeed roller can allow the heat seal to cool down or settle without tearing the freshly applied seal apart. For example, the outfeed roller could either stop or even roll backwards some for the sealing step. Then, once the sealing bars have moved away from the elongate web, the outfeed roller can start to slowly increase tension in the web by driving forward to allow the seal time to set before moving the elongate web at the normal transport torque.

In a further embodiment, the packaging device further comprises a filling station along the web trajectory configured to feed the discrete medicaments in the pouches in the elongated web, and wherein the infeed roller is arranged upstream of the filling station in the transport direction. Preferably, the filling station is arranged upstream of the scaling station in the transport direction.

The driven output roller can pull the elongate web along the web trajectory through the packaging device. The gradual increase in the torque of the output roller can reduce strain or stresses in the elongate web. In particular, a strain on the seal applied in step c) can be reduced. Moreover, the transport at constant torque can prevent sudden increases in the tension of the elongate web. This is especially beneficial when a seal needs to settle, e.g. a heat seal or a chemical bond. Hence, tearing or rupture of the seal and the pouch as a whole can be prevented. Thus, the overall quality and reliability of the pouches can be improved. Additionally, the jumping of medicaments in their respective pouches due to sudden increases of tension can be prevented. Consequently, the risk of medicaments jumping out of their respective pouches can be mitigated.

In an embodiment thereof, the web drive comprises a driven infeed roller upstream of the sealing station in the transport direction for feeding the elongate web in the transport direction to the sealing station. The driven infeed roller allows a better control of the tension in the elongate web.

In a further embodiment, the control unit is arranged to drive the driven output roller at a higher circumferential velocity than the driven infeed roller. Hence, the elongate web can be kept at a constant tension. Moreover, sagging can be prevented. As a consequence, the sealings can be applied more reliably.

In a further embodiment, the control unit is arranged to reverse the direction of the output roller during step b) to reduce the torque on said output roller, for example, reversing the roller by 1-5 mm. This can be before or during the sealing station applying one or more seals, e.g., pressing one or more scaling bars into the elongate web. By reversing the direction of the output roller, the tension in the elongate web can be severely reduced. Hence, the sealings are formed and allowed to cool, cure or settle better before being subjected to additional forces.

In an embodiment, the packaging device further comprises one or more dancer rollers. These can be upstream of the driven infeed roller and/or downstream of the driven outfeed roller. Such one or more dancer rollers can According to a third aspect, the invention provides a method for packaging discrete medicaments in pouches, wherein the method comprises the steps of:

a) guiding an elongate web in a transport direction along a web trajectory at a constant tension with a web drive with an output roller;
b) releasing tension in the elongate web while locally applying a seal to the elongate web for forming at least a part of a pouch in the elongate web;
c) tensioning the elongate web by driving the output roller at a constant first velocity to gradually increase the torque; and
d) transporting the elongate web further in the transport direction along the web trajectory at a constant tension.

By releasing the tension in the elongate web, the sealings can be placed more reliably and reduce the risk of the sealing being broken or damaged from the elongate web tension and transport movement. The tension can be released by either keeping the elongate web stationary and/or reversing the output roller. Hence, the sealings are allowed to settle better. In a further embodiment, preceding step c), the method comprises the step of feeding the discrete medicaments to a subsequent pouch. Feeding the medicament to a subsequent pouch while or shortly after sealing a preceding pouch can speed up process efficiency.

In a preferred embodiment, the method comprises repeating steps a) to d) for forming at least a part of a subsequent pouch.

According to a fourth aspect, the invention relates to a computer program product having a non-transitory computer readable medium with instructions saved thereon that, when executed by a processor, cause a packaging device to perform the method according to the present invention. The computer program product incorporates the method according to the present invention and, thus, has the same advantages as described above.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached schematic drawings, in which.

DETAILED DESCRIPTION OF THE INVENTION

Figure 1:
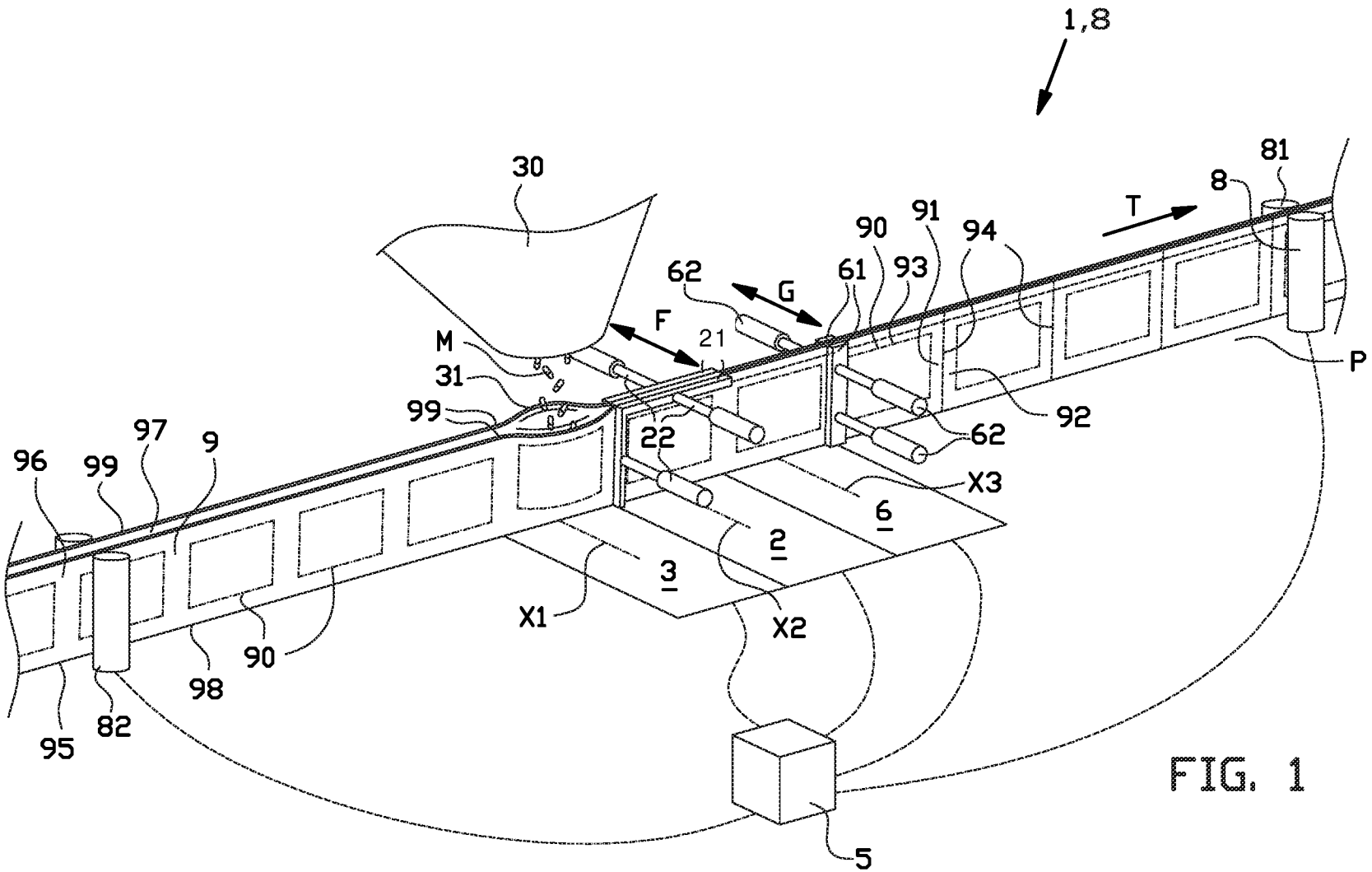
FIG. 1 shows an isometric view of a packaging device for packaging discrete medicaments according to an exemplary embodiment of the present invention.
Figure 2:
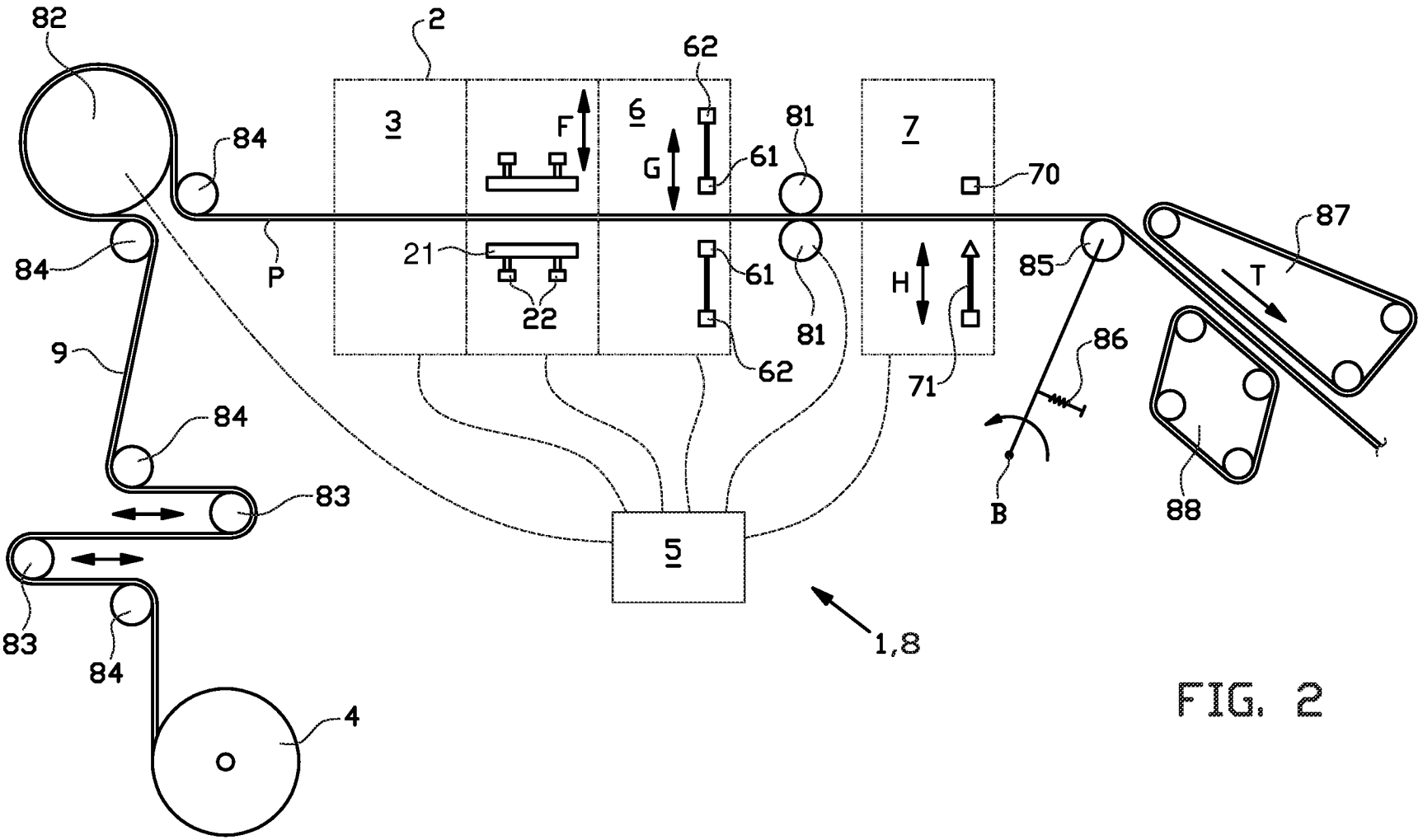
FIG. 2 shows a top view of the packaging device according to FIG. 1.

FIGS. 1 and 2 show a packaging device 1 for packaging discrete medicaments M in pouches 90 according to an embodiment of the present invention. The packaging device 1 is arranged to form and fill said pouches 90 in an elongated web 9 to contain the medicaments M.

The packaging device 1 comprises a web drive 8 for intermittent transport of the elongated web 9 in a transport direction T along a web trajectory P through the packaging device 1. As is shown in FIG. 2, the elongated web 9 is typically rolled off a stock reel 4. Alternatively, the elongated web 9 may for example be fed to the packaging device 1 from an extruder or any other web feeding device. The web drive 8 may output the elongated web 9 for example to a further processing station or an intermediate storage station (not shown).

In this particular embodiment, the elongated web 9 comprises a plastic foil 95 that is folded back onto itself. The elongated web 9 comprises a first side 96 that continues into a second side 97 via a fold that forms a bottom edge 98. Alternatively, the first side 96 and the second side 97 may be formed as separate webs, each having a bottom edge 98. In said alternative embodiment, the bottom edges 98 are arranged to be sealed or joined together. The first side 96 and the second side 97 both have a top edge 99 at the same or substantially the same height with respect to the bottom edge 98.

During the transport through the packaging device 1 in the transport direction T, the elongated web 9 is provided with sealings 91, 92, 93. Preferably, said sealings 91, 92, 93 are heat sealings. Alternatively, said sealings 91, 92, 93 may for example be pressure bonds or glued seals. The sealings 91, 92, 93 comprise an elongated first seal 91, an elongated second seal 92 and an elongated third seal 93 between the front side 96 and the back side 97. The first seal 91 and the second seal 92 extend parallel to each other and transverse to the bottom edge 98. The third seal 93 extends between said first seal 91 and said second seal 92. The third seal 93 extends parallel or substantially parallel to the top edges 99. Preferably, said third seal 93 is spaced apart from the top edge 99. The pouches 90 are each formed as a sealed off enclosures between the bottom edge 98 and the sealings 91, 92, 93 to contain and preserve the selection of discrete medicaments M.

As is shown in FIGS. 1 and 2, the web drive 8 comprises a driven output roller 81 downstream of the sealing station 2 in the transport direction T. In particular, the web drive comprises a set of two driven output rollers 81. Said driven output roller 81 are arranged on opposite sides of the elongate web 9. Preferably, said driven output rollers 25 81 are knurled rollers. In this particular embodiment, the driven output roller 81 are comprised within the packaging device 1, however, the driven output rollers may also be comprised in further device downstream of the packaging device 1 in the transport direction T.

The web drive 8 further comprises a driven infeed roller 82 upstream of the scaling station 2 in the transport direction T. In other words, the sealing station 2 is located along the web trajectory P between the driven infeed roller 82 and the driven output roller 81. Optionally, the web drive may comprise a set of two driven infeed roller 82 arranged on opposite sides of the elongate web 9.

As is shown in FIG. 2, the web drive 8 comprises auxiliary rollers 84 for guiding the elongate web 9 around the circumference of the driven infeed roller 82. Preferably, the auxiliary rollers 84 are positioned such that the web trajectory P of the elongate web 9 comprises at least fifty percent of the circumference of the driven infeed roller 82. More preferably, the web trajectory P comprises at least sixty percent, most preferably at least seventy of the circumference of the driven infeed roller 82. For example, the elongate web 9 may be guided along the circumference of the driven infeed roller 82 over two-hundred-and-seventy degrees with respect to the rotation axis of said driven infeed roller 82. Additionally or alternatively, the driven infeed roller 82 may extend at an oblique angle with respect to the web trajectory P. In other words, the infeed roller 82 extends transverse to a plane defined by the web trajectory P.

Figure 4:
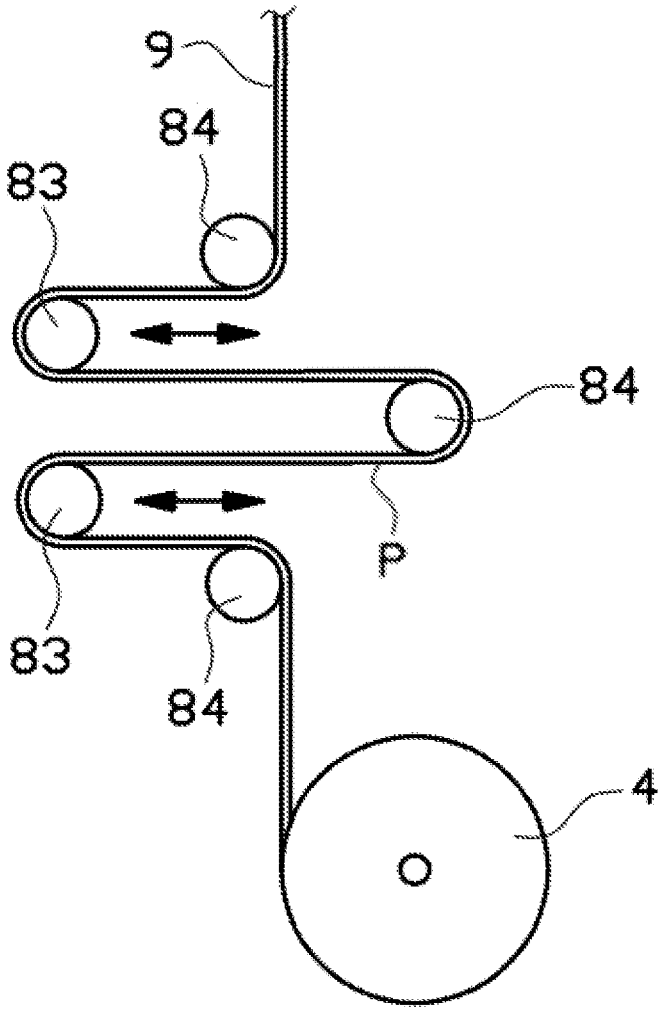
FIG. 4 shows an alternative embodiment of a dancer arrangement at the input of the packaging device according to FIG. 2.

As is further shown in FIG. 2, the web drive 8 comprises two infeed dancer rollers 83 between the infeed roller 82 and the stock reel 4. In an alternative embodiment, as is shown in FIG. 4, the two dancer rollers 83 may be positioned at the same side of the elongate web 9 or the web trajectory P, having a guide roller 84 between them. In this configuration, the two dancer rollers 83 are movable in the same direction when increasing or decreasing the length of the web trajectory P. Optionally, the two dancer rollers 83 are coupled to move together, synchronously or in sync. Alternatively, the web drive 8 may be provided with a single infeed dancer roller 83 between upstream of the infeed roller 82. Where the web drive 8 is arranged for intermittent transport of the elongate web 9, the stock reel 4 is better suited for feeding the elongate web 9 to the web drive 8 at a continuous velocity. The infeed dancer rollers 83 can mitigate any sudden changes in tension in the elongate web 9 caused by the transition from the continuous transport at the reel 4 to the intermittent transport at the web drive 8. Moreover, the dancer rollers 83 can keep the elongate web 9 between said dancer rollers 83 and the driven infeed roller 82 tensioned. Consequently, the elongate web 9 can more reliably contact the circumference of the driven infeed roller 82. Hence, the driven infeed roller may more precisely and/or reliably control the movement of the elongate web 9.

As is further shown in FIG. 2, at the output of the packaging device 1, downstream of the output rollers 81, the web drive 8 further comprises an output mechanism 87, 88 for transporting the elongate web 9 away from the packaging device 1. In this particular embodiment, the output mechanism 87, 88 comprises a first timing belt 87 and a second timing belt 88 opposite to said first timing belt 87 with respect to the elongate web 9. In other words, the output mechanism 87, 88 is arranged to transport the elongate web 9 between said first timing belt 87 and said second timing belt 88.

The web drive 8 further comprises an output dancer roller 85 between the output rollers 81 and the output mechanism 87, 88. The output dancer roller 85 is pivotable about a dancer axis B. In the embodiment as shown, the output dancer roller 85 is biased towards the output rollers 81 by a biasing element 86. Alternatively, the output dancer roller 85 may for example be biased by gravity.

The web drive 8 further comprises multiple further auxiliary rollers 84 for guiding the elongate web 9 along the web trajectory P.

As is further shown in FIGS. 1 and 2, the packaging device 1 comprises a scaling station 2, a filling station 3, and a perforating station 6 along the web trajectory P. The sealing station 2, the filling station 3, and the perforating station 6 are located between the infeed roller 82 and the output rollers 81. The sealing station 2 is arranged downstream of the filling station 3 in the transport direction T. The perforating station 6 is arranged downstream of the scaling station 2 in the transport direction T. Alternatively, the perforating station 6 and the sealing station 2 may be formed as a single station. As is shown in FIG. 2, the packaging device 1 further comprises a cutting station 7 for cutting the elongate web 9 in separate lengths.

The sealing station 2 comprises two stamps or sealing presses 21 that are moveable or driven relative to one another in a sealing direction F transverse to the transport direction T. In particular, the sealing direction F is transverse to the elongated web 9. Preferably, the stamps or sealing presses 21 are heat seal stamps, configured to from heat sealings in the elongate web 9.

Preferably, the two stamps or sealing presses 21 are movable in a symmetric manner by means of a schematically shown stamp drive 22 to form the seals 91, 92, 93. In particular, the stamps or sealing presses 21 are L-shaped, i.e. one leg of the L-shape is arranged to apply the third seal 93, while the other leg of the L-shape is arranged to apply the second seal 92 to a first pouch 90 and to simultaneously apply the first seal 92 to a second pouch 90, upstream of the first pouch 90 in the transport direction T. As is best shown in FIG. 1, the filling station 3 comprises a hopper 30 for receiving the discrete medicaments M from a feeder device (not shown). The filling station 3 further comprises a spreader 31 arranged below the outlet of the hopper 30. The spreader 31 is configured to spread the first side 96 and the second side 97 of the elongated web 9 at the top edges 99 to receive the selection of discrete medicaments M.

Preferably, the web trajectory P is inclined with respect to the horizontal plane between the driven infeed roller 82 and the driven output rollers 81 with an web inclination angle. In particular, web trajectory P descends with respect to the horizontal plane between the driven infeed roller 82 and the driven output rollers 81. In other words, between said driven infeed roller 82 and the driven output rollers 81, the transport direction Z has a negative vector component in the vertical direction. The web inclination angle may cause the discrete medicaments M to move towards the first scaling 91 within the pouch 90. Hence, the discrete medicaments M can be more reliably retained within said pouch 90, even when the second sealing 92 and the third sealing 93 have not yet been applied to said pouch 90. Preferably the web inclination angle is at least 30 degrees. More preferably the web inclination angle is at least 45 degrees.

The perforation station 6 comprises two perforation mechanisms, here shown as perforation anvils 61 that are moveable or driven relative to one another in a perforation direction G transverse to the elongated web 9. Similar to the sealing presses 21, the perforation anvils 61 in a symmetric manner by means of a schematically shown perforation anvil 10 drive 62 to form a perforation line 94 and, optionally, a tear notch (not shown) between two adjacent pouches 90. The perforation line 94 extends transverse to the transport direction T. Preferably, said perforation line 94 extends between the second seal 92 of a first pouch 90 and the first 15 seal 91 of a consecutive pouch 90. In particular, the perforation line 94 extends parallel or substantially parallel to said first seal 91 and said second seal 92. In an alternative embodiment (not shown) in which the perforating station 6 and the sealing station 2 are formed 20 as a single station, the perforation anvils 61 are formed within the scaling presses 21. Hence, when closing said combined sealing presses 21 and perforation 61, the first sealing 91, the second sealing 92 and the perforation line 94 are all applied simultaneously. Hence, the sealing line 25 94 can be positioned more reliably between said first scaling 91 and said second sealing 92.

The cutting station 7 is arranged downstream of the output rollers 81. Hence, when the elongate web has been cut, a leading end of the length of the elongate web 9 upstream of the cutting station 7 may still be retained between the output rollers 81. Preferably, when transporting said leading end in the transport direction T towards the output mechanism 87, 88, the elongate web 9 is transported at a relatively low velocity, e.g., a velocity lower than a velocity of the output mechanism 87, 88, to allow said output mechanism 87, 88 to securely grip the leading end. When a predetermined length of the elongate web 9 following the leading end has been retained by the output mechanism 87, 88, normal operation of the packaging device 1 is resumed.

A trailing end of the length of the elongate web 9 downstream of the cutting station 7, on the other hand, may be transported further by the output mechanism 87, 88. The cutting device 7 comprises a cutting anvil 70 and a cutter 71. The cutter is movable relative to the cutting anvil 70 in a cutting direction H for cutting the elongate web 9.

Figure 3A:
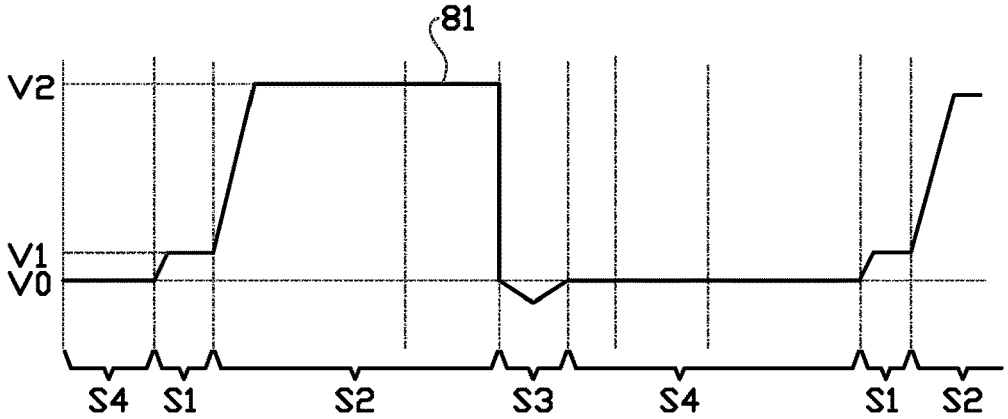
FIGS. 3A-3D show motion profiles for driving an elongated web through said packaging device.
Figure 3B:
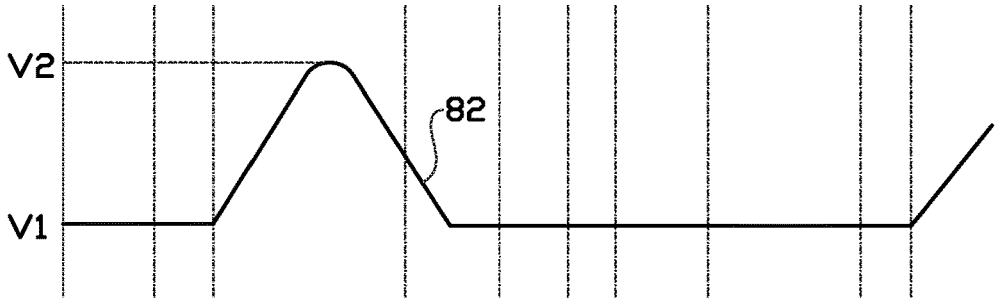
Figure 3C:
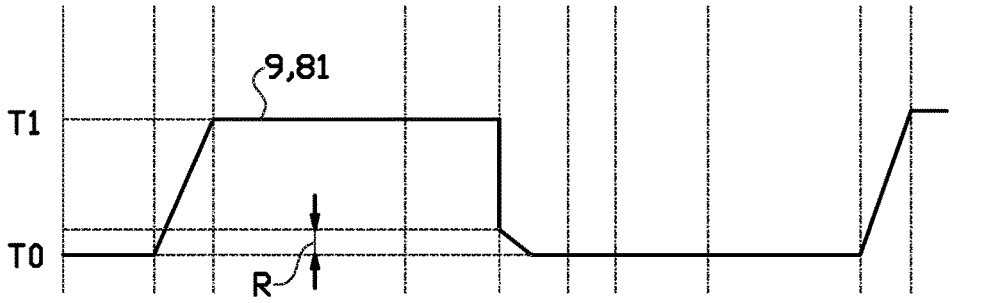
Figure 3D:
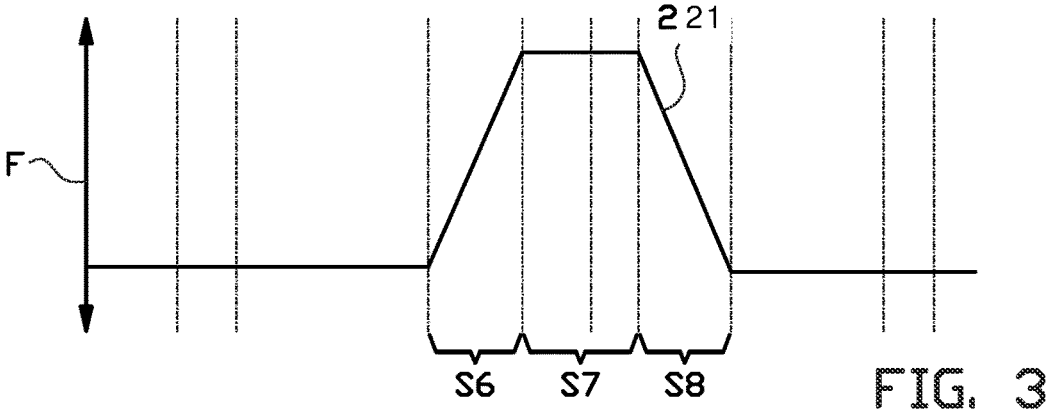

As is schematically shown in FIGS. 1 and 2, the packaging device 1 comprises a control unit 5 that is operationally connected with the sealing station 2, the filling station 3, the perforation station 6, and the web drive 8. Preferably, the control unit 5 is further operationally connected to the cutting station 7. The control 15 unit 5 comprises an electronic processor and a tangible, non-transitory memory for storing instructions, program code or software which, when executed by the processor, cause the control unit 5 to control the actuation of these parts. In particular, the control unit 5 is arranged to control the web drive 8 to intermittently transfer the elongate web 9 along the web trajectory P in the transport direction T. For this purpose, the control unit 5 is arranged to impart the motion profile of FIG. 3A to the output rollers 81. The control unit 5 is further arranged to impart the motion profile of FIG. 3B on the infeed roller 82. FIG. 3C shows the target torque profile for the output rollers 81. The torque of the output rollers 81 corresponds to or substantially corresponds to the tension in the elongate web 9. The control unit 5 is further arranged to control the sealing station 2 to impart the motion profile of FIG. 3D to the sealing clamp 21.

A method for packaging the discrete medicaments M in the pouches 90 is now described using FIGS. 1, 2 and 3A-3C.

As is shown in FIGS. 1 and 2, the elongate web 9 has been positioned in the packaging device 1, such that it extends along the web trajectory P. During the packaging, the stock reel 4 is preferably unwound at a constant or substantially constant rotational velocity. Accordingly, the output mechanism 87, 88 is arranged to transfer the elongate web 9 away from the packaging device 1 at a constant or substantially constant velocity. As is shown in FIGS. 3A-3C, initially, the packaging device 1 is in a rest stage or idle stage S4. This stage may for example occur after a pouch 90 has been sealed. As is shown in FIG. 3A, in said idle stage S4, the output rollers 82 are stationary or at an idle output velocity V0. The infeed roller 81 is stationary as well or at an idle infeed velocity U1. The elongate web 9 is at an initial tension imparting an idle torque T0 on the output rollers 81. Preferably, the initial tension in the elongate web 9 is negligible, resulting in a zero or substantially zero idle torque TO. The negligible tension in the elongate web 9 can allow the sealings 91, 92, 93 of the pouch to cool and/or settle. The portion of the elongate web 9 between the reel 4 and the infeed roller 82 is kept at a constant tension using the infeed dancer rollers 83. Accordingly, the output dancer 85 smoothens out any tensions in the portion of the elongate web 9 between the output rollers 81 and the output mechanism 87, 88.

Following the idle stage S4 is a tensioning stage S1. In said tensioning stage S1, the control unit 5 controls the output rollers 81 to rotate at a constant first output velocity V1. Said output velocity V1 is chosen significantly lower than an average transport velocity of the elongate web 9. The infeed roller 81 is kept at the idle infeed velocity U1. As a result, the elongate web 9 is gradually tensioned and gradually increases the torque on the output rollers 82 from the idle torque T0 to a transport torque T1.

When the control unit 5 senses that the transport torque T1 acts on the output rollers 81, said control unit 5 initiates a transport stage S2. In said transport stage S2, the control unit 5 controls the output rollers 82 to accelerate to a second output velocity V2 higher than the first output velocity V1. Simultaneously or substantially simultaneously, the control unit controls the infeed roller 81 to accelerate from the idle infeed velocity U1 towards an active infeed velocity U2, higher than the idle infeed velocity U1. Consequently, the elongate web 9 is transported in the transport direction T along the web trajectory P. A pouch 90 at a first position X1 at the filling station 3 is thus displaced towards a second position X2 at the scaling station 2. Accordingly, an adjacent pouch 90 at the second position X2 is displaced towards a third position X3 at the perforation station 6. A pouch 90 at the third position X3 is transported further in the transport direction T and a pouch 90 upstream from and adjacent to the pouch at the first position X1 is displaced towards said same first position X1.

As is shown in FIG. 3C, during the transport stage S2 the control unit 5 is arranged to keep the torque acting on the output rollers 82 constant or substantially constant at the transport torque T1. Accordingly, the tension in the elongate web 9 is kept constant or substantially constant as well. Preferably, the control unit 5 is arranged to actively adapt the velocity of the infeed roller 81 to affect the constant or substantially constant torque at the output rollers 82.

Towards the end of the transport stage S2, the control unit 5 initiates a first scaling stage S6 at the sealing station 2. During said first sealing stage S6, the sealing presses 21 are displaced towards one another in the sealing direction F. In other words, the sealing station 2 is being closed. During the closing of the sealing station 2, the sealing presses 21 may already initiate a longitudinal seal, e.g., a seal extending in the transport direction T, such as the third seal 93.

Following the first sealing stage S6 is the second sealing stage S7. During the second sealing stage S7, the sealing bars 21 are clamping the elongate web 9 to form both the elongate third seal 93 and the first and second seals 91, 92 in a direction transverse to the transport direction T. Simultaneously, the control unit 5 initiates a relaxation stage S3 for the input roller 82 and the output rollers 81. Preceding said relaxation stage S3, the input roller 82 has been decelerated back to the idle infeed velocity U1. The output rollers 81 have been brought to a standstill. This can be a sudden deceleration of the elongate web 9, which can help the medicines in already filled pouches to move towards the front of the pouch. This can help to ensure that medicines are properly positioned in the pouch, for example, out of the way for further sealing and/or are in the desired position for inspection and rolling up for packaging and shipping.

The control unit 5 now controls the output rollers 81 to rotate back, for example, 1-5 mm, to release the tension in the elongate web 9. Thus, the torque imparted on the output rollers 81 is further reduced by a relaxation interval R to the initial idle torque TO.

The dispensing of the medicaments can also be precisely timed with this process to ensure that the medicines drop into the pouches without harming the seals. For example, in some embodiments, the dropping of the medicines and clamping can be precisely coordinated (e.g., delay clamping) such that the medicines drop into the pouch just after the clamps close form the first and second seals 91, 92 in the second sealing stage S7. The precise release time of the medicines and clamping can be calculated knowing the specific medicines, drop distance, clamp movement speed, etc.; to ensure the clamps are closed to form the seals at the precise time the medicines drop into the foil forming the pouch. This can help to ensure that the dropping of the medicines does not negatively affect the seals being formed, particularly in a system which is angled so the medicines may be dropping directly onto a seal.

Following the relaxation stage S3 is a rest stage or idle stage S4 in which the sealings 91, 92, 93 are allowed to cool and/or settle. During the idle stage S4, the input roller 82 and the output rollers 81 are kept at their respective idle velocities U1, V0. During the relaxation stage S3, the sealing station 2 is opened in third sealing stage S8. The opening of the scaling station 2 allows the elongate web 9 to be transported further in the transport direction T.

The control unit 5 is arranged to keep the packaging device 1 in the idle stage S4 for a predetermined period of time to allow the sealings 91, 92, 93 to rest. Typical time intervals for the idle stage S4, in particular the part of the idle stage S4 between the end of the third sealing stage S8 and the beginning of the next tensioning stage S1, are between 25 and 500 milliseconds. Preferably, said time interval is between 30 and 200 milliseconds. In some embodiments, during the idle stage S4, the pouch at the first position X1 is filled at the filling station 3.

Following the idle stage S4, the control unit 5 is arranged to initiate a consecutive tensioning stage S1 and to repeat the abovementioned process stages S1, S2, S3, S4.

In summary, the control unit 5, in particular, the tangible, non-transitory memory of said control unit 5, comprises instructions saved thereon that, when executed by the processor, cause the packaging device 1 to perform the above described method.

Figure 5:
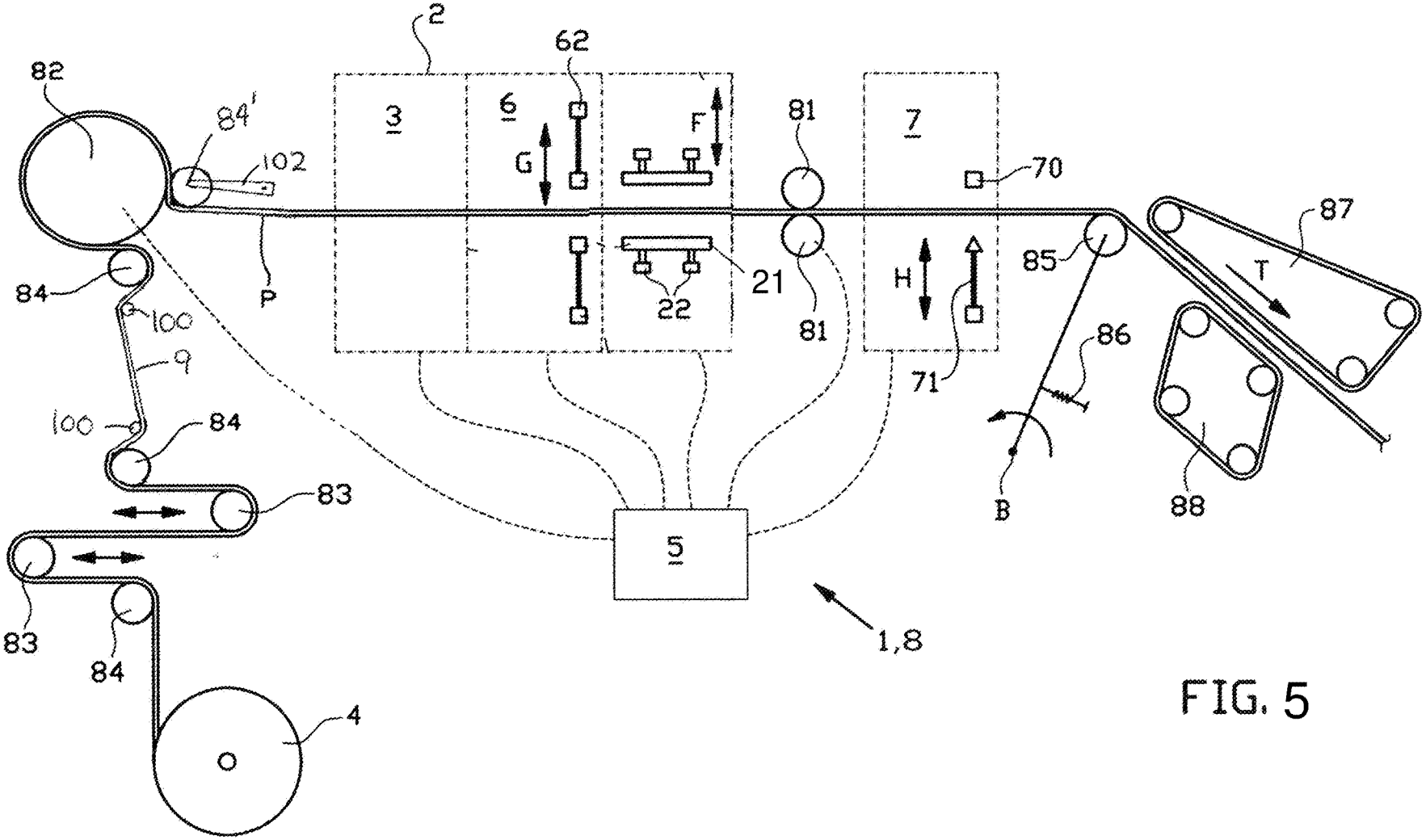
FIG. 5 shows a schematic alternative embodiment of a top view of the packaging device.

FIG. 5 shows a further embodiment of a packaging device, and operates similarly to the embodiment shown in FIG. 2. Thus, only differences will be discussed. In the embodiment shown in FIG. 5, the perforating station is first, and then the scaling station is arranged downstream of the perforating station in the transport direction T, before outfeed rollers 81. The system also include pins 100 and spring-loaded roller holder 102 to hold pressure roller 84'.

Pins 100 are smaller in diameter than rollers 84 (e.g., 2-10 mm in diameter), and are positioned just outside the shortest (elongated web) path between rollers 84. Elongated web 9 must wrap around pins 100 first, and then around rollers 84, as shown in FIG. 5. Including smaller-diameter pins for elongate web 9 to wrap around helps to take wrinkles and/or folds out of elongated web 9, ensuring that the elongate web extends through packaging device in an unfolded state for properly forming pouches. While two pins 100 are shown, more or fewer could be used, and they could be positioned differently, for example, at different places along the packaging device elongate web trajectory.

Roller 84' is shown with a holder 102 which is rotatable to hold roller 84' against roller 82 with some force. Spring-loaded holder 102 is shown schematically, and could include more parts, such as another link, cylinder, spring, etc. Holder 102 can be spring-loaded, exerting a constant force (e.g., 25 kilos) that holds the elongated web 9 between roller 82 and roller 84'. The holder 102 is constructed such that it applies higher force in the operational position of the holder, and lower force in the 'opened' position, or 'loading' position. The force should be at a level that an operator can easily overcome the loading force to rotate or move holder into the open position for loading or unloading an elongate web. Such force can be, for example, 5-15 Newtons using a gas-loaded spring. The force also brings the holder 102 with roller 84' back into the position shown in FIG. 5 to hold the web 9 against the infeed roller 82 once the operator lets go and allows holder to return to its normal loading position. The movement of the holder 102 is also typically limited such that it cannot open towards a 'stable' open position. This prevents the machine from being started with the holder 102 in the open position. The holder 102 (and/or various associated components) can include one or more holes or other gripping features for the manual manipulation of the holder by the operator.

Roller 84' can, in some embodiments, be built up from a series of small rollers, stacked on the same roller axis. Such an arrangement can help in removing small wrinkles in one or both layers of the elongated web as it allows small speed differences needed for removal of the wrinkles.

The use of roller 84' with a spring-loaded holder 102 ensures that elongated web 9 stays connected to roller 82 for driving elongated web 9 through the packaging device and maintaining the desired tension at various parts of the packaging process. The spring-loading pushes roller 84' against roller 82 such that there is no space between the two and elongated web 9 remains frictionally driven by roller 82. In some past systems, dust or other contaminants could make it such that web 9 would not remain connected to roller 82 and/or would lose friction and slip such that it was not precisely driven by roller 82. Roller 84' with spring loaded holder helps to ensure that there is constant force to maintain the connection between web 9 and roller 82 for precise driving during operations, while holder 102 is still easy for an operator to overcome the force to allow for loading and/or unloading. By configuring such that the force holds the roller 84' in the position shown in FIG. 5 when not subjected to external forces, the holder will always ensure the roller is applying pressure during operations and it does not require manual closing. This also helps to avoid accidentally forgetting to properly position the roller 84' to apply force, and can prevent that the machine does not start due to the roller being in an open position.

It is to be understood that the above description is included to illustrate the operation of the preferred embodiments and is not meant to limit the spirit and scope of the invention. From the above discussion, many variations will be apparent to one skilled in the art that would yet be encompassed by the scope of the present invention.

LIST OF REFERENCE NUMERALS

1 packaging device
2 sealing station
21 stamp or sealing press
22 stamp drive
3 filling station
30 hopper
31 spreader
4 stock reel
5 control unit
6 perforation station
61 perforation anvil
62 perforation drive
7 cutting station
70 cutting anvil
71 cutter
8 web drive
81 driven output roller
82 driven infeed roller
83 infeed dancer roller
84 auxiliary roller
84 pressure roller
85 output dancer roller
86 dancer roller biasing element
87 first timing belt
88 second timing belt
9 elongate web
90 pouch
91 first seal
92 second seal
93 third seal
94 perforation line
95 plastic foil
96 first side
97 second side
98 bottom edge
99 top edge
100 pins
102 spring-loaded roller holder
B dancer axis
F sealing direction
G perforating direction
H cutting direction
M medicament
P web trajectory
S1 tensioning stage
S2 transportation stage
S3 relaxation stage
S4 idle stage
S6 first scaling stage
S7 second sealing stage
S8 third scaling stage
T transport direction
T0 idle torque
T1 transport torque
U1 idle infeed velocity
U2 active infeed velocity
V0 idle output velocity
V1 first output velocity
V2 second output velocity
X1 first position
X2 second position
X3 third position

The invention claimed is:

1. A packaging device for packaging discrete medicaments in pouches, the packaging device comprising:

a web drive for guiding an elongated web of pouches in a transport direction (T) along a web trajectory (P), a sealing station along the web trajectory (P), wherein the sealing station is configured to apply a seal in the elongated web to form at least a part of a pouch, a driven output roller downstream of the sealing station in the transport direction (T), and a control unit that is operationally connected to the sealing station and the web drive, wherein the control unit is configured to perform the steps of:

a) controlling the web drive to drive the elongate web in the transport direction (T) along a web trajectory (P) at a constant transport torque (T1) of the output roller;

b) controlling the web drive to cease the transportation of the elongate web and controlling the sealing station to locally apply a seal to the elongate web for forming at least a part of a pouch; and c) controlling the web drive to drive the output roller at a constant first velocity (V1) to increase the torque back to the transport torque (T1), wherein the control unit is arranged to reverse the direction of the output roller during step b) to reduce the torque on said output roller.

2. The packaging device according to claim 1, wherein the control unit controls output roller to reverse direction and rotate the output roller by 1-5 mm when the sealing station is applying a seal to the elongate web.

3. The packaging device according to claim 1, wherein the control unit is configured to keep the packaging device in the idle stage for a predetermined period of time between step b) and step c).

4. The packaging device according to claim 3, wherein the predetermined period of time is between 10 and 750 milliseconds.

5. The packaging device according to claim 1, wherein the output roller is a knurled roller.

6. The packaging device according to claim 1, wherein the packaging device further comprises a dancer upstream of the driven infeed roller.

7. The packaging device according to claim 6, wherein the dancer comprises two dancer rollers.

8. The packaging device according to claim 1, wherein the web drive further comprises a driven infeed roller upstream of the sealing station in the transport direction (T) for feeding the elongate web in the transport direction (T) to the sealing station.

9. The packaging device according to claim 8, wherein the web wraps around at least fifty percent of the circumference of the infeed roller.

10. The packaging device according to claim 8, wherein the web drive comprises two auxiliary rollers for guiding the elongate web along the circumference of the infeed roller.

11. The packaging device according to claim 8, wherein the control unit is arranged to drive the driven output roller at a higher circumferential velocity than the driven infeed roller.

12. The packaging device according to claim 1, wherein the web drive further comprises one or more pins slightly outside the shortest path between rollers.

13. The packaging device according to claim 1, wherein the sealing station comprises a press for applying the seals to the elongate web by pressing said elongate web together in a sealing direction (F) transverse to the transport direction (T).

14. The packaging device according to claim 13, wherein the press is a hot press and wherein the seals are heat seals.

15. The packaging device according to claim 13, wherein step c) begins only after the sealing station has moved the press away from the elongate web.

16. The packaging device according to claim 1, wherein step b) is performed with a sudden deceleration of the transportation of the elongate web.

17. The packaging device according to claim 1, wherein the packaging device further comprises a filling station along the web trajectory (P) configured to feed the discrete medicaments (M) in the pouches in the elongated web.

18. The packing device according to claim 1, wherein the control unit comprises a processor and a tangible, non-transitory memory for storing instructions which, when executed by the processor, cause the control unit to control the actuation of the sealing station, driven output roller and the web drive.

19. A method for packaging discrete medicaments (M) in pouches using the packaging device of claim 1, wherein the method comprises the steps of:

a) guiding an elongate web in a transport direction (T) along a web trajectory (P) at a constant tension with a web drive with an output roller;

b) releasing tension in the elongate web by reversing the output roller, and locally applying a seal to the elongate web for forming at least a part of a pouch in the elongate web;

c) tensioning the elongate web by driving the output roller at a constant first velocity (V1) to increase the torque back to the transport torque (T1); and d) transporting the elongate web further in the transport direction (T) along the web trajectory (P) at a constant tension.

20. The method according to claim 19, wherein, preceding step c), the method comprises the step of feeding the discrete medicaments (M) to a subsequent pouch.

21. The method according to claim 19, wherein the control unit comprises a processor and a tangible, non-transitory memory for storing instructions which, when executed by the processor, cause the packaging device to perform the method.

* * * * *